US011692735B2

(12) United States Patent
Rimmer

(10) Patent No.: US 11,692,735 B2
(45) Date of Patent: Jul. 4, 2023

(54) HUMIDIFIER AUXILIARY DRAIN PAN

(71) Applicant: Alan C. Rimmer, Mechanicsburg, PA (US)

(72) Inventor: Alan C. Rimmer, Mechanicsburg, PA (US)

( * ) Notice: Subject to any disclaimer, the term of this patent is extended or adjusted under 35 U.S.C. 154(b) by 42 days.

(21) Appl. No.: 17/450,303

(22) Filed: Oct. 8, 2021

(65) Prior Publication Data

US 2023/0114511 A1 Apr. 13, 2023

(51) Int. Cl.

| | |
|---|---|
| ***F24F 13/22*** | (2006.01) |
| ***F24F 13/32*** | (2006.01) |
| ***F24F 11/88*** | (2018.01) |

(52) U.S. Cl.

CPC ..... *F24F 13/222* (2013.01); *F24F 11/88* (2018.01); *F24F 13/32* (2013.01)

(58) Field of Classification Search

CPC ..... F24F 13/222; F24F 13/32; F24F 11/88; F24F 2013/227; B60H 1/3233; F25D 21/14

See application file for complete search history.

(56) References Cited

U.S. PATENT DOCUMENTS

| | | | |
|---|---|---|---|
| 2,234,846 | A | 3/1941 | Strobush et al. |
| 2,449,709 | A | 9/1948 | Mesite |
| 3,596,475 | A | 8/1971 | Berger |
| 4,474,232 | A | 10/1984 | Wright et al. |
| 4,513,586 | A | 4/1985 | Jennings et al. |
| 4,793,147 | A | 12/1988 | Cho |
| 4,941,901 | A | 7/1990 | Ramakrishnan et al. |
| 4,970,875 | A | 11/1990 | Kim |
| 5,117,650 | A | 6/1992 | Kim |
| 5,522,229 | A | 6/1996 | Stuchlik, III et al. |
| 5,664,431 | A | 9/1997 | Martin, Sr. |
| 5,715,697 | A | 2/1998 | Rust, Jr. et al. |
| 5,755,105 | A | 5/1998 | Lacoste |

(Continued)

FOREIGN PATENT DOCUMENTS

| | | |
|---|---|---|
| EP | 2122266 A1 | 11/2009 |
| KR | 200493478 | 10/2020 |

(Continued)

OTHER PUBLICATIONS

Goliath Series Secondary Drain Pans, RectorSeal, p. 1-3, USA.

(Continued)

*Primary Examiner* — David J Teitelbaum
*Assistant Examiner* — Devon Moore
(74) *Attorney, Agent, or Firm* — McNees Wallace & Nurick LLC

(57) ABSTRACT

An auxiliary drain pan for installation vertically below a humidifier. The pan has a base and a peripheral wall around the base and a single opening formed in the base adapted to form an anti-backflow connection with a conduit from the humidifier for directing liquid from the humidifier through the opening and a drainage connector, the anti-backflow connection preventing a reverse flow of liquid from the opening into the humidifier. The pan has a structure for supporting the base and having connecting features for connection with a vertical surface in an installed position, with the base secured in a substantially horizontal position in the installed position.

15 Claims, 3 Drawing Sheets

(56) References Cited

U.S. PATENT DOCUMENTS

| | | | | |
|---|---|---|---|---|
| 5,854,518 | A | 12/1998 | Revis | |
| 5,987,909 | A | 11/1999 | Martin, Sr. | |
| 6,112,536 | A | 9/2000 | Hansen | |
| 6,229,229 | B1 | 5/2001 | Sharp | |
| 6,868,689 | B1 | 3/2005 | McNeil et al. | |
| 6,895,770 | B1 * | 5/2005 | Kaminski | F24F 13/222 62/285 |
| 6,978,909 | B2 | 12/2005 | Goetzinger et al. | |
| 7,185,513 | B2 | 3/2007 | Bush et al. | |
| 7,284,388 | B2 | 10/2007 | Yoshida | |
| 7,673,646 | B1 * | 3/2010 | Cantolino | F24F 13/222 137/15.01 |
| 7,900,795 | B1 * | 3/2011 | Cantolino | F24F 13/222 220/571 |
| 7,938,288 | B2 | 5/2011 | Oakner et al. | |
| 8,220,282 | B2 | 7/2012 | Hast et al. | |
| 8,430,115 | B2 | 4/2013 | Stieb | |
| 8,769,979 | B2 | 7/2014 | Timbs et al. | |
| 8,869,548 | B2 | 10/2014 | Piccione | |
| 9,074,812 | B2 | 7/2015 | Rowland | |
| 9,410,731 | B1 | 8/2016 | Rowland | |
| 9,631,833 | B2 * | 4/2017 | Arensmeier | F24F 13/222 |
| 9,677,785 | B2 | 6/2017 | Neihouse et al. | |
| 9,958,182 | B1 | 5/2018 | Rimmer | |
| 2002/0000093 | A1 | 1/2002 | Lea | |
| 2007/0169493 | A1 | 7/2007 | Rios | |
| 2008/0047289 | A1 | 2/2008 | Patrick et al. | |
| 2008/0142525 | A1 | 6/2008 | Brouillette | |
| 2012/0158188 | A1 | 6/2012 | Madala | |
| 2012/0159981 | A1 | 6/2012 | Beck et al. | |
| 2014/0331698 | A1 | 11/2014 | Daley | |
| 2015/0153094 | A1 | 6/2015 | Mercer et al. | |
| 2016/0123651 | A1 | 5/2016 | Barbely et al. | |
| 2016/0265807 | A1 | 9/2016 | Platt et al. | |
| 2022/0146145 | A1 * | 5/2022 | Hatcher | F24F 13/20 |

FOREIGN PATENT DOCUMENTS

| | | | |
|---|---|---|---|
| WO | 2008084277 | A1 | 7/2008 |
| WO | 2012028469 | A2 | 3/2012 |

OTHER PUBLICATIONS

HE Series Premier Indoor Evaporator Coils Product Guide, Advanced Distributor Products, p. 1-4, Stone Mountain, GA, USA, Apr. 2016.

Air Conditioning Pump Condensate Drip Trays, Defects, Repairs, InspectAPedia.com, 2015, p. 1-5.

* cited by examiner

HUMIDIFIER AUXILIARY DRAIN PAN

FIELD OF THE INVENTION

The present invention is directed to the field of apparatus and methods for liquid overflow protection, and in particular, for apparatus and methods for humidifier liquid overflow protection.

BACKGROUND OF THE INVENTION

Liquid collection systems are used, for example, in humidifiers in enclosed spaces. Irrespective the system, liquid, whether in the form of condensation created by or otherwise associated with the operation of such systems must be removed to prevent damage to the enclosed spaces or associated contents. A conventional system includes a primary drain pan, which is typically positioned within the humidifier, and receives all liquid generated during operation of the system. The primary drain pan further includes an opening for directing collected liquid to a drain.

Secondary or auxiliary drain pans are positioned vertically beneath a humidifier for emergency purposes, e.g., catching overflow liquid from the humidifier due to a malfunction of the primary drain pan. Unfortunately, there may be insufficient floor space to accommodate a conventional secondary or auxiliary drain pan, and constructing a separate support frame in such tight quarters can prove to be a difficult undertaking.

Moreover, even when the primary drain pan is functioning properly, a drainage back-up, resulting in reverse flow or backflow of liquid from the drain toward the primary drain pan can occur. Due to plumbing requirements, a connection must be inserted between the opening in the primary drain pan and the drain to prevent the reverse flow or backflow of liquid from the drain from reaching the primary drain pan. As a result, although the reverse flow or backflow of liquid from the drain is prevented from reaching the primary drain pan, such reverse flow may not be prevented from otherwise flowing through the inserted connection and causing damage to the structure or contents within the structure adjacent the inserted connection.

There is a need in the art for a humidifier auxiliary drain pan that addresses these shortcomings.

SUMMARY OF THE INVENTION

An embodiment is directed to a humidifier auxiliary drain pan for installation vertically below a humidifier including a base and a continuous wall around a periphery of the auxiliary drain pan extending upwardly from the base to form a container having an open end. The drain pan further includes a single opening formed in the base, the opening having a drainage connector extending from the base opposite the wall for connecting with a drainage conduit, the opening adapted to receive a backflow preventer for forming an anti-backflow connection with a humidifier conduit extending from the humidifier for directing liquid from the humidifier through the opening and the drainage connector, the anti-backflow connection preventing a reverse flow of liquid from the drain conduit into the humidifier via the humidifier conduit. The drain pan further includes a structure extending from the base for supporting the base, the structure having connection features for connection with a vertical surface in an installed position, the structure securing the base in a substantially horizontal position in the installed position.

A further embodiment is directed to a method for providing liquid overflow protection for a humidifier system including positioning an auxiliary drain pan vertically below a humidifier, the auxiliary drain pan having a base, a continuous wall around a periphery of the auxiliary drain pan extending upwardly from the base to form a container having an open end and a single opening formed in the base. The method further includes forming a fluid tight connection between the opening and a drainage conduit. The method further includes forming an anti-backflow connection between the opening and a conduit from the humidifier for directing liquid from the humidifier through the opening and into the drainage conduit, the anti-backflow connection preventing a reverse flow of liquid from the drain conduit from reaching the humidifier through the humidifier conduit.

A further embodiment is directed to a humidifier system for providing climate control to a space including a humidifier and an auxiliary drain pan positioned vertically below the humidifier. The auxiliary drain pan includes a base and a continuous wall around a periphery of the auxiliary drain pan extending upwardly from the base to form a container having an open end. The auxiliary drain pan further includes a single opening formed in the base, the opening having a drainage connector extending from the base opposite the wall for connecting with a drainage conduit; the opening adapted to receive a backflow preventer for forming an anti-backflow connection with a humidifier conduit extending from the humidifier for directing liquid from the humidifier through the opening and the drainage connector, the anti-backflow connection preventing a reverse flow of liquid from the drain conduit into the humidifier via the humidifier conduit. The auxiliary drain pan further includes a liquid accumulation protector for removing electrical power to the humidifier when activated as a result of sensing an accumulation of liquid in the auxiliary drain pan. The auxiliary drain pan further includes a structure extending from the base for supporting the base, the structure having connection features for connection with a vertical surface in an installed position, the structure securing the base in a substantially horizontal position in the installed position.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

The present invention provides a novel auxiliary drain pan having an opening for accommodating liquid flow therethrough from a humidifier to a drain. In case the drain is clogged, the opening also forms an anti-backflow connection preventing a reverse flow or backflow of "waste water" or liquid from the drain into the humidifier. Additionally, the drain pan includes a liquid accumulator protector that, in case of humidifier primary drain pan failure resulting in liquid accumulation in the auxiliary drain pan, activates a power control unit to shut off power to the humidifier. Further, the drain pan includes structure for supporting the drain pan, and providing a convenient means for simplifying the installation of the drain pan. The structure has connection features for connecting or securing the drain pan to a vertical surface or suspending the drain pan from the humidifier, as floor space may not be available in the region surrounding the humidifier. Moreover, even the floor space is available in the region surrounding the humidifier, positioning a conventional drain pan on the floor, which is generally at least 4 feet to 5 feet vertically below the humidifier, results in the drain pan becoming a "splash pad" that is not effective, and subjects the enclosed space and its surroundings to water damage. These features will be discussed in further detail below.

For purposes herein, the terms "humidifier auxiliary drain pan," "auxiliary drain pan," "humidifier secondary drain pan," "secondary drain pan," "drain pan" and the like may be used interchangeably.

Figure 1:
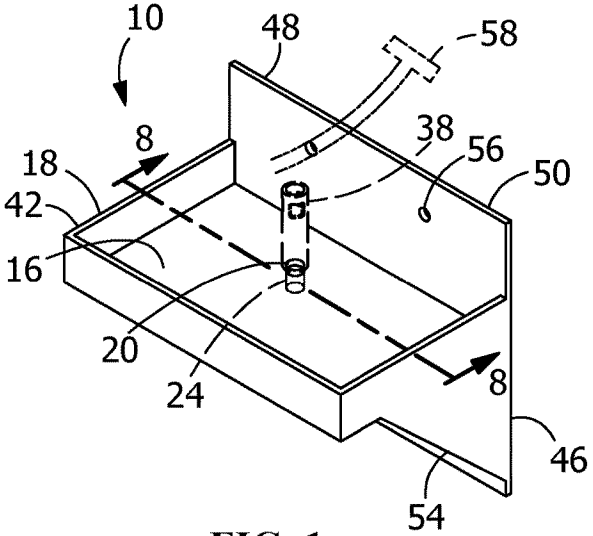
FIG. 1 is an upper perspective view of an exemplary auxiliary drain pan.
Figure 2:
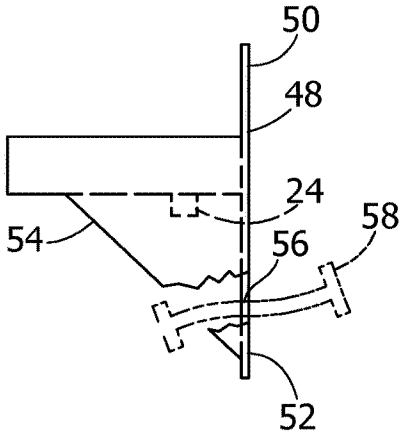
FIG. 2 is an elevation side view of the auxiliary drain pan of FIG. 1.
Figure 3:
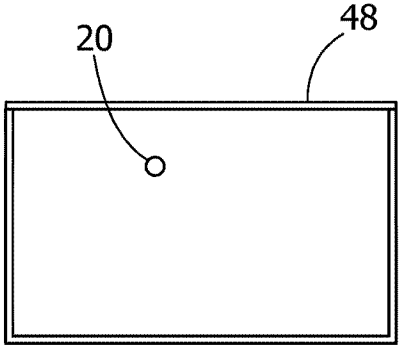
FIG. 3 is a plan view of the auxiliary drain pan of FIG. 1.
Figure 4:
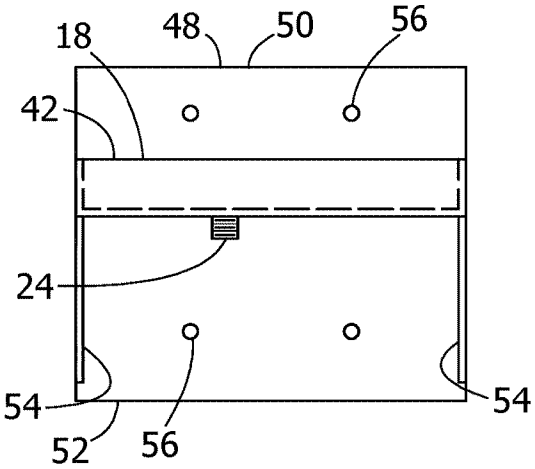
FIG. 4 is a plan view of the auxiliary drain pan of FIG. 1.
Figure 6:
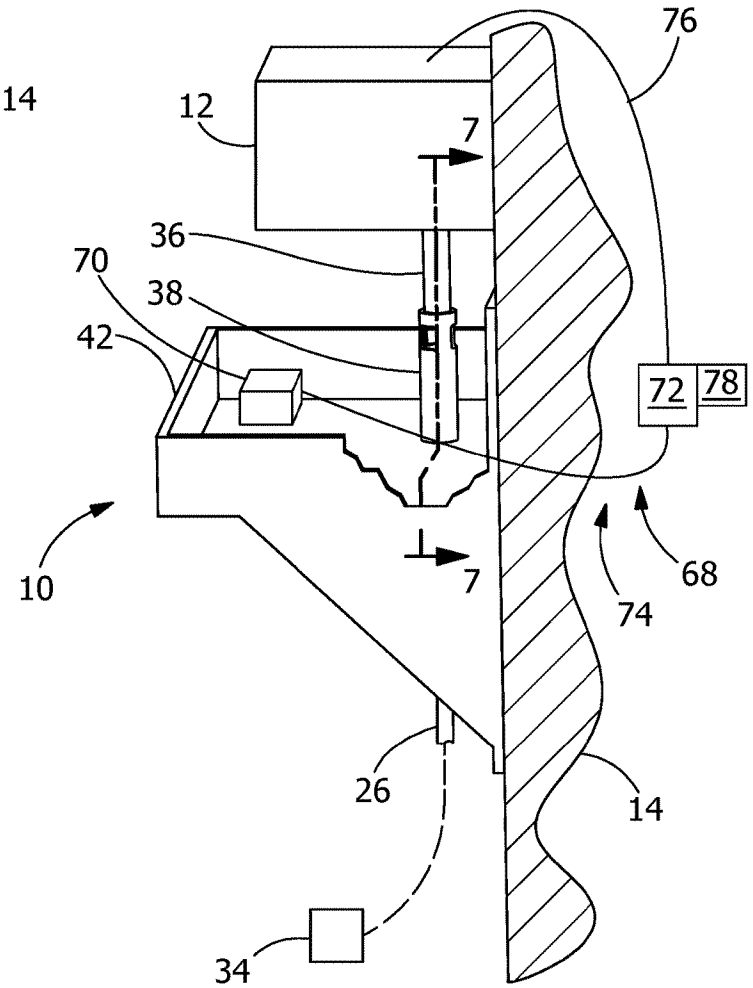
FIG. 6 is an upper perspective view of an exemplary humidifier.

FIG. 6 shows a humidifier system 100 including an auxiliary drain pan 10 positioned vertically below a humidifier 12, each being supported by a vertical surface or wall 14. In one embodiment, the auxiliary drain pan is positioned vertically beneath the humidifier. Preferably, the vertical spacing separating humidifier 12 and auxiliary drain pan 10 is sufficiently small such that liquid dropping from the humidifier into the drain pan does not result in splashing, which could result in water damage of the enclosed space and/or contents thereof. In one embodiment, vertical wall 14 includes a wall structure of the enclosed space. In one embodiment, vertical wall 14 includes ducting for distributing or moving air interacting with a climate control system, such as an HVAC unit. Shown for purposes of clarity in FIG. 6, optionally, auxiliary drain pan 10 includes a liquid accumulation protector 68 that includes a sensor 70 that is adapted to detect an accumulation of water in the auxiliary drain pan 10 and send a signal to a power control unit 72 as part of a conventional electrical circuit/system that shuts off power to humidifier 12. Optionally, a failure indicator 78 is provided that includes, but is not limited to providing failure indicia, such as illuminating failure lights, activating an audible alarm or other suitable action. Other features of the novel auxiliary drain pan 10 will be discussed in further detail below.

As further shown in FIGS. 1-4, auxiliary drain pan 10 includes a base 16, with a continuous wall 18 extending upwardly around a periphery of base 16 to form a container having an open end, with base 16 forming the closed end of the container. An opening 20 is formed in base 16. Opening 20 includes a drainage connector 24 extending away from base 16 in a direction opposite of wall 18. Drainage connector 24 is adapted to connect with one end of a drainage conduit 26 (FIG. 6), with the other end of first drainage conduit 26 connecting to drain 28 (FIG. 6). In one embodiment, base 16 can have a planar surface. In one embodiment, base 16 can have a non-planar surface. When placed in an installed position, base 16 is substantially horizontal such that liquid accumulating on the surface of the base will result in sensor 70 (FIG. 6) of liquid accumulation protector 68 (FIG. 6) that is adapted to detect an accumulation of water in the auxiliary drain pan 10 and send a signal to a power control unit 72 as part of a conventional electrical circuit/system that shuts off power to humidifier 12.

It is to be understood that drainage connector 24 can utilize threads, such as pipe threads, quarter-turn fasteners, barbs, treated surfaces, including protrusions and/or recesses and surfaces adapted to increase the static coefficient of friction, clamps, adhesives, or other features or mechanical components or combination thereof in order to secure a fluid tight connection with the respective drainage conduit 26. In one embodiment, drain pan 10 and drainage connector 24 are of one-piece or unitary construction, such as produced by injection molding. The drain pan can be constructed of any suitable material, such as a plastic, having acceptable material properties, including corrosion resistance, rigidity and material strength.

Figure 7:
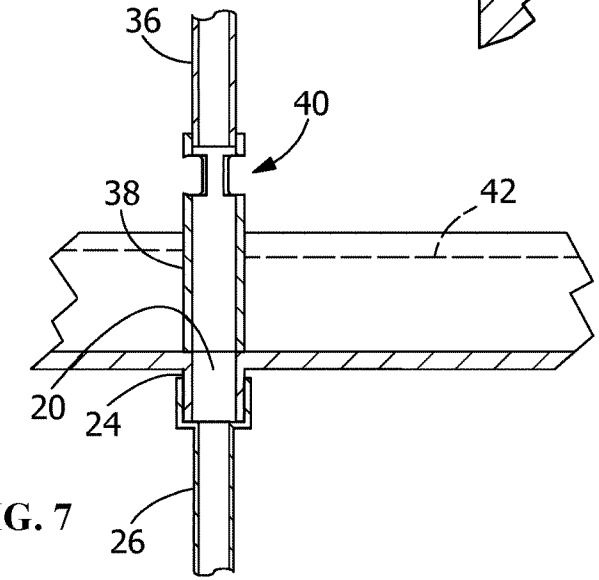
FIG. 7 is a cross-section taken along line 7-7 of the humidifier of FIG. 6.

As further shown in FIGS. 6-7, humidifier 12 of humidifier system 100 includes a humidifier conduit 36 for directing liquid away from the humidifier. As shown, humidifier conduit 36 is fluidly connected to a backflow preventer 38. Backflow preventer 38 prevents an unintentional reversal of flow or backflow through the humidifier conduit into the humidifier. In one embodiment, a backflow preventer can incorporate an air gap, which is generally defined as an unobstructed vertical distance through the free atmosphere between the lowest opening of a liquid-providing source (e.g., a pipe or tube) and the flood-level rim of the liquid-receiving source (e.g., a top surface of a wall of the drain pan). The distance is generally two (2) times the effective diameter of the liquid-providing pipe or tube. In one embodiment, backflow preventer 38 is connected to one end of humidifier conduit 36. In one embodiment, backflow preventer 38 is inserted between opposed ends of humidifier conduit 36. In either arrangement, backflow preventer 38 is received (i.e., either directly or indirectly) by opening 20.

It is to be understood other embodiments of backflow preventers may be utilized, such as valves or other mechanical devices, including valves controlled by control systems, although a backflow preventer in the form of an air gap fitting has no moving parts and is less expensive than other types of backflow preventers.

As further shown in FIGS. 6-7, backflow preventer 38 is directly received by opening 20 with an air gap portion 40 of the backflow preventer positioned vertically above a top surface 42 of wall 18, thereby preventing a backflow of liquid from drain 28 into drain pan 10.

Figure 8:
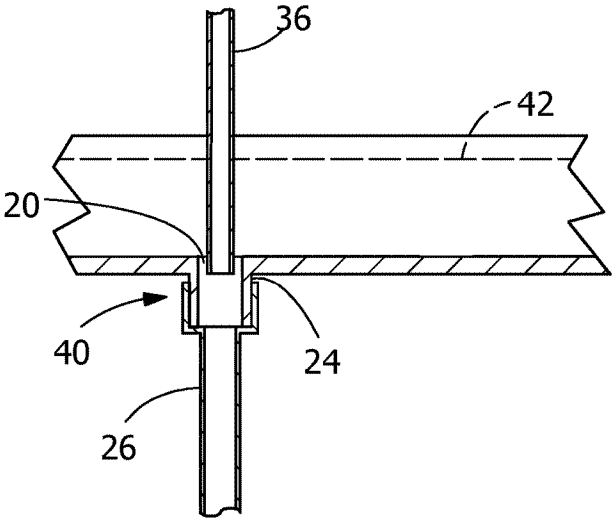
FIG. 8 is a cross-section taken along line 8-8 of the auxiliary drain pan of FIG. 1.

In one embodiment, as shown in FIG. 8, which is taken along line 7-7 of FIG. 6, the end of humidifier conduit 36 is inserted into opening 20, and can extend into or even through drainage connector 24 and into drainage conduit 26. The end of humidifier conduit 36 and the proximate or laterally corresponding portion of drainage connector 24 or drainage conduit 26 forms an air gap portion 40. As long as the diameter of the end of humidifier conduit 36 is generally one half of the effective diameter of the proximate or laterally corresponding portion of drainage connector 24 and drainage conduit 26, an unintentional reversal of flow or backflow from drainage conduit 26 to humidifier 12 (FIG. 6) via humidifier conduit 36 is prevented.

In one embodiment, the footprint of the pan, i.e., the lateral surface area of base 16 (FIG. 1), is less than the footprint of the humidifier. In one embodiment, the footprint of the pan is equal to or greater than the footprint of the humidifier.

Figure 10:
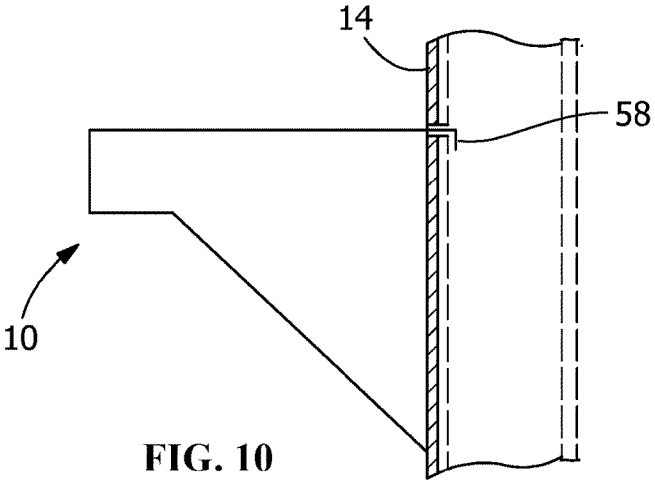
FIG. 10 is an elevation side view of an exemplary auxiliary drain pan secured to a vertical surface.

As further shown in FIGS. 1-4, drain pan 10 includes a support structure 46. As shown, structure 46 includes a back plate 48 having a portion 50 extending away from base 16 in one direction beyond or past top surface 42 of wall 18, and a portion 52 extending away from base 16 in a direction opposite portion 50. Structure 46 further includes a support member 54 such as a pair of gussets extending from opposed edges of portion 52 to base 16 for providing additional structural support for the drain pan. Back plate 48 includes a plurality of connection features 56 including openings formed through back plate 48, as well as fasteners 58, such as blind fasteners such as screws and toggle bolts, as well as other kinds of fasteners including nuts and bolts, hooks, tape, including adhesive tape, clamps or other suitable mechanical fasteners or devices for securing the drain pan to vertical surface or wall 14 (FIG. 6). As shown in FIGS. 10, an exemplary drain pan 10 is secured by fastener 58, in the form of a hook, to vertical surface 14, which in this instance is a ventilation duct. As further shown in FIG. 6, the portion of vertical surface or wall 14 to which the drain pan is secured is not a surface of humidifier 12, as the humidifier is positioned vertically above the drain pan. As further shown in FIG. 6, when the drain pan is installed or placed in an installed position, structure 46 and connection features 56 secure base 16 (FIG. 1) in a substantially horizontal position such that backflow preventer 38, openings 20, 22 and associated connectors, conduits and drains operate in a manner as previously discussed.

It is to be understood that with the drain pan supported in an installed position, the support structure can extend beneath the base.

Figure 5:
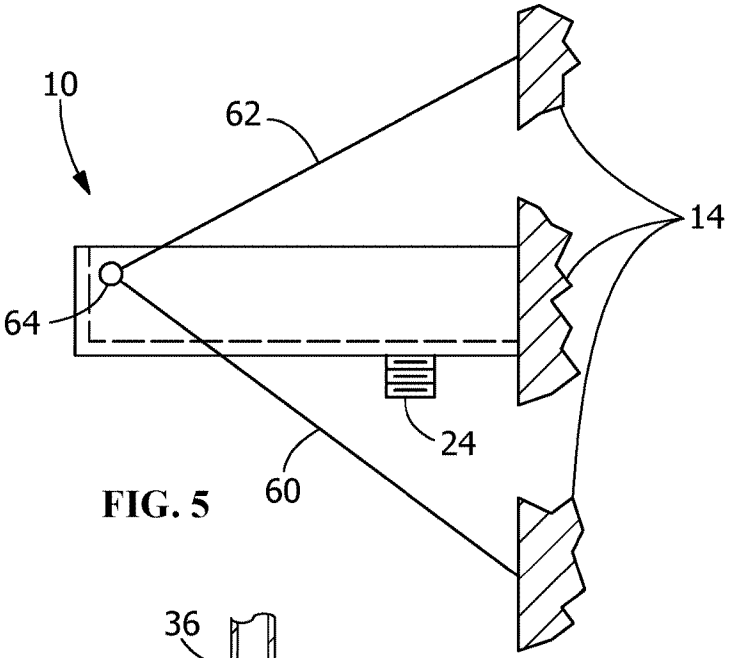
FIG. 5 is an elevation side view of an exemplary auxiliary drain pan.

For example, as shown in FIG. 5, one or more of support members 60, 62 can be used to provide structural support for drain pan 10. Support member 60 is connected at one end to a portion of vertical wall 14 that is vertically below the drain pan in the installed position, and to a pivotable support 64 at the other end. Support member 60 has rigidity to withstand compressive forces. Support member 62 is connected at one end to a portion of vertical wall 14 that is vertically above the drain pan in the installed position, and to a pivotable support 64 at the other end. Support member 60 does not require rigidity, but must be able to withstand tensile forces.

Figure 9:
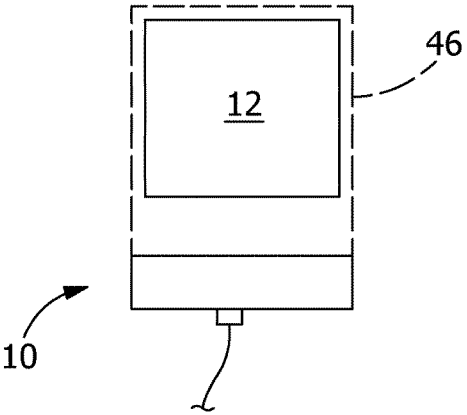
FIG. 9 is an elevation front view of an exemplary auxiliary drain pan for humidifier.

In one embodiment, as shown in FIG. 9, structure 46 extends over humidifier 12 such that drain pain 10 is suspendedly supported thereby. Structure 46 can be a strap or include one or more elongate members secured to or extending over humidifier 12 to support drain pan 10. In other words, drain pan 10 does not need to be supported or secured to vertical wall 14 (FIG. 6).

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A humidifier auxiliary drain pan for installation vertically below a humidifier, consisting of:

a base;

a continuous wall around a periphery of the auxiliary drain pan extending upwardly from the base to form a container having an open end;

a single opening formed in the base, the opening having a drainage connector extending from the base opposite the wall for connecting with a drainage conduit; the opening adapted to receive a backflow preventer for forming an anti-backflow connection with a humidifier conduit extending from the humidifier for directing liquid from the humidifier through the opening and the drainage connector, the anti-backflow connection preventing a reverse flow of liquid from the drain conduit into the humidifier via the humidifier conduit; and a structure extending from the base for supporting the base, the structure having connection features for connection with a vertical surface in an installed position, the structure securing the base in a substantially horizontal position in the installed position.

2. The auxiliary drain pan of claim 1, wherein the auxiliary drain pan and the drainage connector are of unitary construction.

3. The auxiliary drain pan of claim 1, wherein the structure extends beneath the base in the installed position, the base having a support member.

4. The auxiliary drain pan of claim 3, wherein the support member is a gusset.

5. The auxiliary drain pan of claim 1, wherein the vertical surface is not a surface of the humidifier.

6. The auxiliary drain pan of claim 1 further comprises a liquid accumulation protector for removing electrical power to the humidifier when activated as a result of sensing an accumulation of liquid in the auxiliary drain pan.

7. A method for providing liquid overflow protection for a humidifier system, consisting of:

positioning an auxiliary drain pan vertically below a humidifier, the auxiliary drain pan having a base, a continuous wall around a periphery of the auxiliary drain pan extending upwardly from the base to form a container having an open end and a single opening formed in the base;

forming a fluid tight connection between the opening and a drainage conduit; and forming an anti-backflow connection between the opening and a conduit from the humidifier for directing liquid from the humidifier through the opening and into the drainage conduit, the anti-backflow connection preventing a reverse flow of liquid from the drain conduit from reaching the humidifier through the humidifier conduit.

8. The method of claim 7, wherein positioning the auxiliary drain pan vertically below the humidifier includes securing the auxiliary drain pan to a vertical surface.

9. The method of claim 7, wherein positioning the auxiliary drain pan includes suspending the auxiliary drain pan from the humidifier.

10. The method of claim 7 further comprises installing a liquid accumulation protector.

11. A humidifier system for providing climate control to a space, consisting of:

a humidifier;

an auxiliary drain pan positioned vertically below the humidifier, the auxiliary drain pan comprising:

a base;

a continuous wall around a periphery of the auxiliary drain pan extending upwardly from the base to form a container having an open end;

a single opening formed in the base, the opening having a drainage connector extending from the base opposite the wall for connecting with a drainage conduit; the opening adapted to receive a backflow preventer for forming an anti-backflow connection with a humidifier conduit extending from the humidifier for directing liquid from the humidifier through the opening and the drainage connector, the anti-backflow connection preventing a reverse flow of liquid from the drain conduit into the humidifier via the humidifier conduit;

a liquid accumulation protector for removing electrical power to the humidifier when activated as a result of sensing an accumulation of liquid in the auxiliary drain pan; and a structure extending from the base for supporting the base, the structure having connection features for connection with a vertical surface in an installed position, the structure securing the base in a substantially horizontal position in the installed position.

12. The auxiliary drain pan of claim 11, further comprising a liquid accumulation device which includes a sensor that is adapted to detect accumulation of liquid in the auxiliary drain pan and sends a signal to a power control unit to shut off power when accumulation of liquid in the auxiliary drain pan is detected.

13. The auxiliary drain pan of claim 12, wherein the sensor is located in the base of the auxiliary drain pan.

14. The auxiliary drain pan of claim 11, further comprising a failure indicator to indicate accumulation of liquid in the auxiliary drain pan is beyond a threshold.

15. The auxiliary drain pan of claim 14, wherein the failure indicator is at least one of an illuminating lights or an audible alarm.

* * * * *